US005331697A

United States Patent [19]

Siegel et al.

[11] Patent Number: 5,331,697

[45] Date of Patent: Jul. 26, 1994

[54] MATTRESS WITH KNITTED MATTRESS TAPE

[75] Inventors: Edmond H. Siegel, New York; Alfred Reisfeld, New Hyde Park, both of N.Y.

[73] Assignee: CT-Nassau Corporation, Alamance, N.C.

[21] Appl. No.: 87,592

[22] Filed: Jul. 7, 1993

Related U.S. Application Data

[62] Division of Ser. No. 726,439, Jul. 5, 1991.

[51] Int. Cl.[5] ..... A47C 27/00; A47C 31/00; B32B 3/06; D03D 23/00

[52] U.S. Cl. ..... 5/474; 5/448; 112/419

[58] Field of Search ..... 5/474, 448; 112/419; 29/91.6; 66/192, 194, 195, 202; 428/102, 171, 193, 212, 213, 253, 218, 225

[56] References Cited

U.S. PATENT DOCUMENTS

| | | | |
|---|---|---|---|
| 1,314,408 | 8/1919 | Lewis | 5/474 |
| 3,889,305 | 6/1975 | Goldberg | 5/459 |
| 4,015,451 | 4/1977 | Gajjar | 66/86 |
| 4,320,634 | 3/1982 | Hashimoto et al. | 66/202 |
| 4,384,021 | 5/1983 | Aoyama | 428/193 |
| 4,430,765 | 2/1984 | Karpen | 5/474 |
| 4,818,316 | 4/1989 | Weinle et al. | 156/88 |
| 5,100,713 | 3/1992 | Homma et al. | 428/102 |

FOREIGN PATENT DOCUMENTS

| | | |
|---|---|---|
| 1027347 | 5/1953 | France . |
| 1236363 | 6/1960 | France . |
| 578382 | 10/1977 | U.S.S.R. . |

*Primary Examiner*—Alexander Grosz
*Attorney, Agent, or Firm*—Stroock & Stroock & Lavan

[57] ABSTRACT

A mattress tape for securing the edge of a mattress comprising a fabric formed of yarn. The fabric has a first section, a second section and a third section disposed between the first section and second section. The third section is formed with greater shape holding capability than the first and second sections. This greater shape holding capability is caused by greater thickness, weight or stiffness of said central third section.

45 Claims, 7 Drawing Sheets

MATTRESS WITH KNITTED MATTRESS TAPE

This is a division of U.S. patent application Ser. No. 07/726,439, filed on Jul. 5, 1991, entitled KNITTED MATTRESS TAPE.

BACKGROUND OF THE INVENTION

The present invention is directed generally to a mattress tape and, in particular, to a knitted mattress tape suited to provide a french seam at the edges of the mattress that produces a minimum amount of wrinkling.

Mattress tape is known in the art as exemplified in U.S. Pat. No. 3,889,305 (Goldberg). This prior art heat barrier textile material is directed to a mattress tape formed of at least 50% by weight of filament yarn and, optionally, the balance spun yarn, the filament yarn and spun yarn being made from a synthetic fiber forming polymer such as a poly (ethyleneglycol terephthalate).

It is noted that as used in this patent "mattress" refers to all types of mattresses and box springs, while "mattress tape" refers to the fabric tape used to finish and close the edges of "mattresses".

In the past, mattress tape has always been woven. Many different patterns of woven mattress tape have been made and many different yarns have been used in the weaves. Yarns ranging from cotton to polyester to nylon to polypropylene have been used. Thus, many different weights of mattress tape have been created using the different yarns.

The prior art mattress tapes have been satisfactory. However, they suffer from the disadvantage of being limited in the designs of the thicknesses, rigidity or shape holding ability. All woven tapes must be of uniform thickness, rigidity, and shape holding capability throughout the width of the tape thereby limiting the degree of shape holding ability that may be obtained by the tape. If the tape is designed too stiff in the edges it will not hold in the track of the mattress binding machines and if the tape is not designed stiff enough in the center it will not be capable of holding its shape without wrinkling. Thus, there is a limit to how firm the tape can be and still sew properly. Further, to achieve the desired shape holding capability in a prior art woven tape, an excess of yarn must be utilized in the edge regions, increasing the cost of the mattress tape.

It is desirable to have a tape that is sewn neatly on the edges and holds in track well while being stiff enough to hold its shape and define a smooth and aesthetically pleasing mattress edge. Further, it is desirable to provide a mattress tape which can achieve the desired appearance and utility while permitting use of less yarn per yard of tape than comparable prior art tapes. Accordingly, it is desirable to provide a mattress tape which overcomes the shortcomings of the prior art configuration described above.

SUMMARY OF THE INVENTION

Generally speaking, in accordance with the invention, a mattress tape construction comprised of a fabric is provided. The fabric mattress tape has a first side section, a second side section and a third center section disposed between the first side section and second side section. The third center section is formed with greater rigidity, thickness and shape holding capability than the first side or second side sections. These fabric qualities are formed by a greater density of material in the third section The third section may be formed with yarns the sum of the denier of which is greater then the sum of the denier of the yarns of the first or second sections. Alternatively, the third center section may be formed stiffer and with enhanced shape holding capability by using yarns in the third center section that are stiffer than the yarns used in the first side or second side sections.

A fabric having greater rigidity in the third center section than in the first side and second side sections may be produced through knitting. Specifically, a warp knit may be used to accomplish the desired result of increased rigidity in the center section while decreasing the rigidity and density of fabric at the side sections. Through warp knitting it is possible to incorporate a large variety of different threads at different sections of the mattress tape.

The preferred method of accomplishing the desired result of increased rigidity in the middle section is through the use of inlays. A relatively thin ground inlay is provided to hold all three sections of the tape together in one coherent fabric. Two side laterally reinforcing inlays are provided to add the desired rigidity to the first and second sections, and a center reinforcing inlay is provided to add the greatest amount of rigidity to the third section. The center reinforcing inlay may be of greater denier or stiffness than the side reinforcing inlays.

An alternative method of accomplishing the desired result is through selection of stitches of greater density for the third center section than are used for the first and second side sections.

It is an object of this invention to provide an improved mattress tape construction.

Another object of this invention is to provide a mattress tape construction which is relatively more rigid in the center section.

Another object of this invention is to provide a mattress tape construction which is stiff, yet is easy to fold and tracks well so that it may be sewn properly.

Yet another object of this invention is to provide a knitted mattress tape which is formed with varying stiffness throughout the width of the tape.

A further object of this invention is to provide a mattress tape which provides an aesthetically pleasing straight edge yet may require less yarn per yard (by weight) than prior art mattress tapes of comparable physical characteristics (firmnessstability).

Still other objects and advantages of the invention will in part be obvious and will in part be apparent from the specification.

The invention accordingly comprises an article of manufacture possessing the features, properties and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

A first embodiment in accordance with the invention consists of a fabric mattress tape having three sections. A first section and a second section on opposite sides of the mattress tape and a third section disposed between the first and second sections. The third center section is formed from either a greater density of material or from materials with greater denier, such that the center is formed thicker than the sides. In the alternative, the third section includes at least some material of greater stiffness. Forming a material with these properties is preferably accomplished through knitting, and in particular, through warp knitting. The preferred embodiment of this invention is one where the thickness and rigidity of the third center section of the mattress tape is provided through a heavy fabric weight of inlays being provided in the middle, and a lighter fabric weight of inlays provided at the end sections thereof. This provides the desired effect at relatively low cost.

Figure 1:
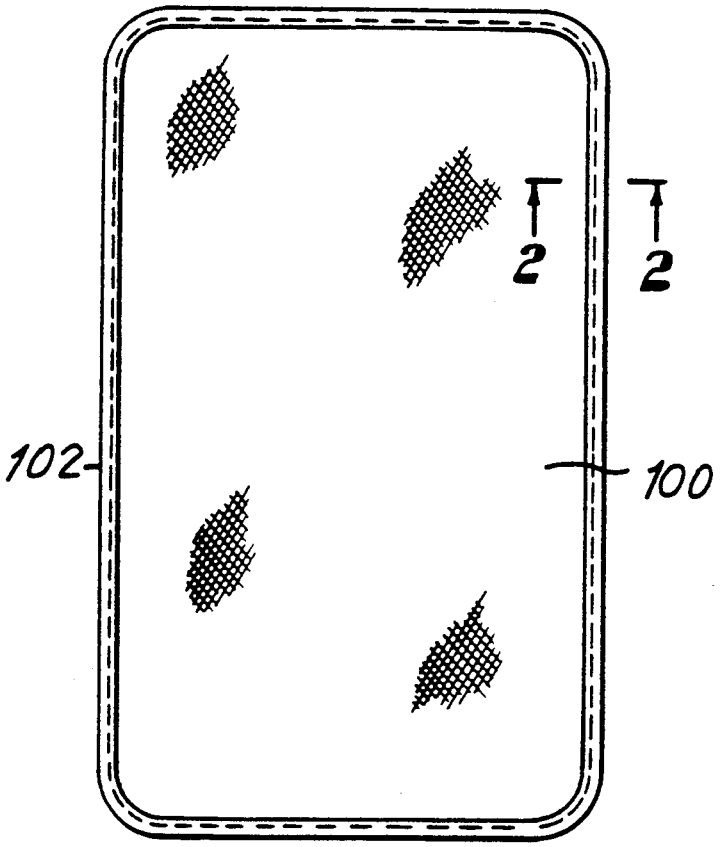
FIG. 1 is a top plan view of a mattress formed with an embodiment of mattress tape in accordance with the invention.
Figure 2:
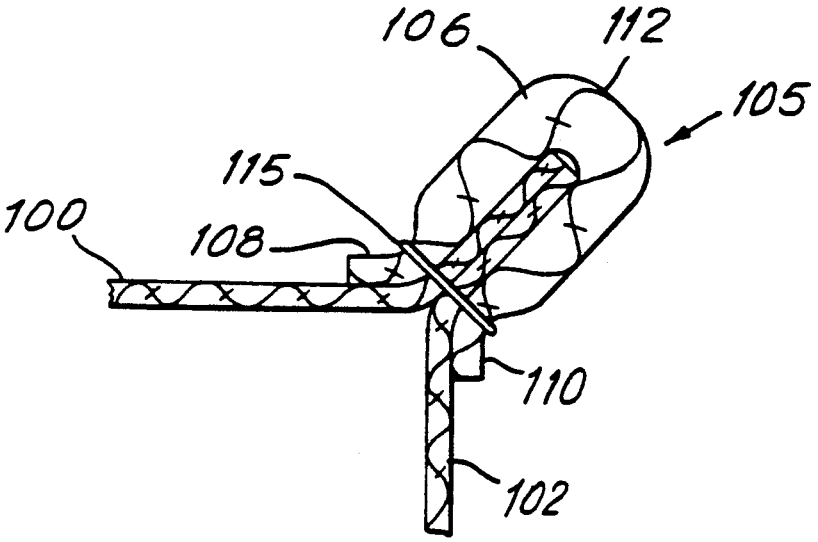
FIG. 2 is an enlarged fragmentary sectional view taken along lings 2—2 of FIG. 1.

Referring specifically to FIGS. 1 and 2, a mattress is depicted wherein top panel 100 is coupled to the border 102 by a french seam. The french seam generally indicated as 105 is covered by a length of mattress tape 106. Specifically, mattress tape 106 covers the edges of top panel 100 and border 102 such that a clean tailored appearance is maintained along the edges of the mattress. Mattress tape 106 has a first side section 108 a second side section 110 and a third center section 112 disposed therebetween.

First side section 108 and second side section 110 of mattress tape 106 are designed to receive stitching 115 therethrough, thereby neatly securing the edge of top panel 100 to the edge of border 102 and encasing the two edges neatly within mattress tape 106. Mattress tape 106 is further provided such that first side section 108 and second side section 110 are thin enough that they track perfectly in a binder so that the two edges come together precisely and may receive a stitch therethrough. The third center section 112 is formed of a heavier fabric weight of material or of a stiffer material that is firmer than the thinner material of first side section 108 and second side section 110. The result is a firm middle section where the rigidity is capable of smoothing out the wrinkles inherent in the taping process, and soft side sections that allow the fabric to fold and track perfectly in the binders.

Figure 3:
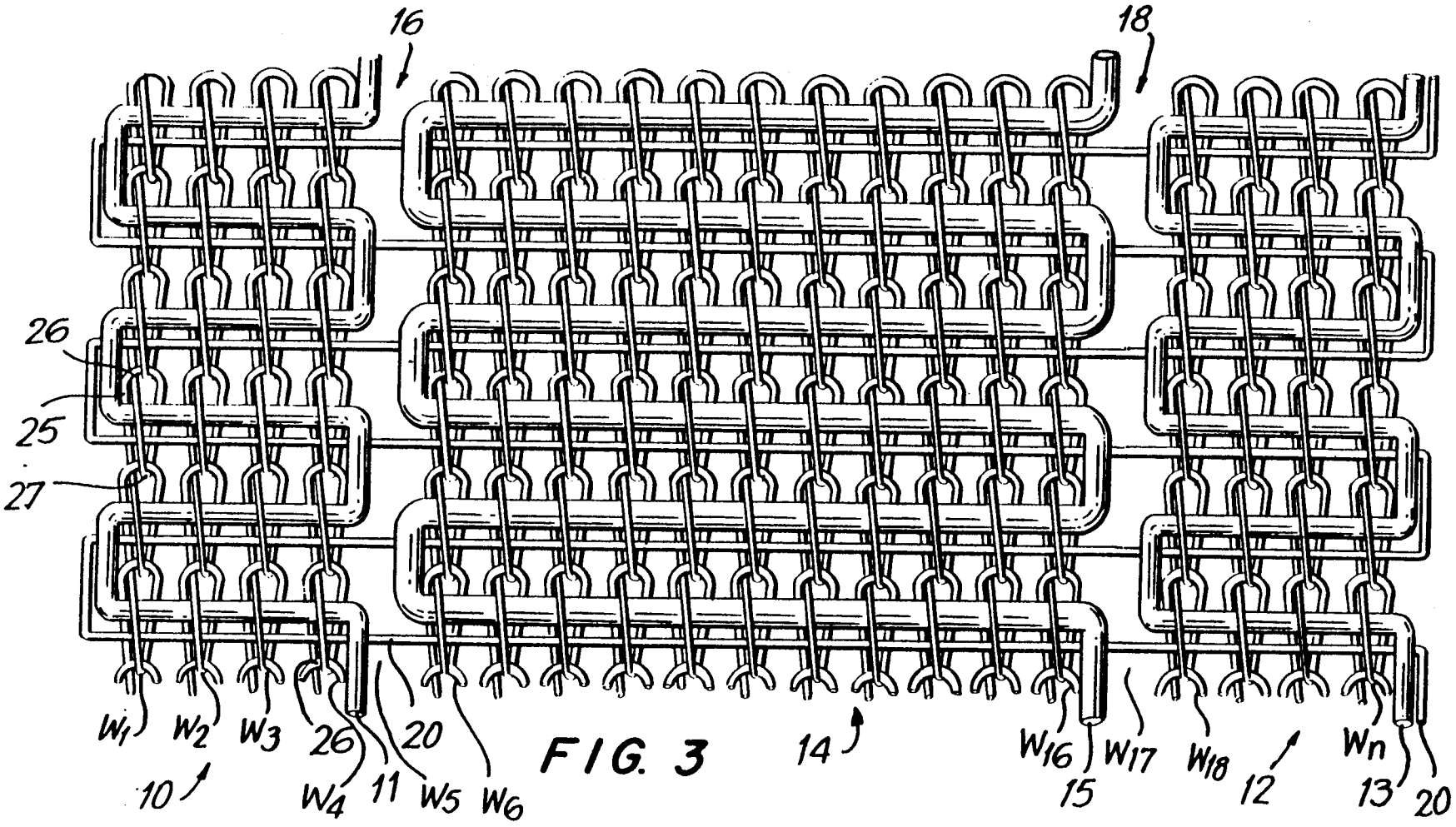
FIG. 3 portrays the reverse technical side of the loop structure of a first embodiment of the present invention.

Referring specifically to FIG. 3 the reverse technical side view of the loop structure of the first preferred embodiment of the invention is depicted. This fabric has a first side section generally indicated as 10, a second side section generally indicated as 12 and a third center section generally indicated as 14 which is interposed between first side section 10 and second side section 12. The three sections are held together in a coherent fabric by ground inlay 20 which is configured to traverse the entire width of the fabric. The ground inlay 20 is held inside each individual loop 25 of each wale $W_1$ through $W_n$. A wale $W_n$ may also be referred to as a pillar of loops or a chain of loops. The chain of loops is also referred to as a pillar stitch. Each chain of loops $W_n$ extends longitudinally up the mattress tape, only six loops 25 being depicted for simplicity. In order to create a transition between the third section 14 and each side section 10, 12, one wale, in this example, $W_5$ and $W_{17}$, is omitted in each transition or space region (yarn bridge). This is achieved by removal of a needle at each of the two wale positions. The yarn bridges formed by the eliminated wales between side sections 10, 12 and center or third section 14 create a hinge effect in the fabric that aids in the manipulation for the sewing process.

Furthermore, first and second side sections 10, 12 have lateral reinforcing inlays 11, 13 respectively for adding the structural support desired in the side sections 10, 12 of the fabric. The third center section 14 is configured with center reinforcing inlay 15 for providing the required stiffness or rigidity needed in center section 14.

The warp knit of FIG. 3 consists of chains of loops $W_n$ where each loop 25 has a top portion 26 and a bottom portion 27. The top portion 26 of each loop is connected to the bottom portion 27 of the next loop in the chain, and the bottom portion 27 is connected to the top portion 26 of the preceding loop. Thus, the loops are connected into a chain of loops.

Ground inlay 20 is configured such that it is surrounded by each loop 25 in the chain of loops. Furthermore, lateral reinforcing inlay 11 is configured to lie inside each loop of the chains of loops $W_1$–$W_4$ that make up first side section 10. Lateral reinforcing inlay 13 is configured to lie within each loop of the chains of loops $W_{16}$–$W_{20}$ of side section 12. Furthermore, center reinforcing inlay 15 is configured to lie inside each loop of the chains of loops $W_5$–$W_{15}$ that comprise the center section 14.

The difference between center section 14 and side sections 10 12 lies in the reinforcing inlay used to reinforce the fabric in each section. When a yarn having a relatively large denier is inlayed into a section of the fabric that section of the fabric will have a thicker and generally stiffer configuration. To generate a certain fabric weight in a portion of a tape, one can either use a single inlay thread of desired denier or several inlay threads of a lower denier which in aggregate will make up the desired denier. Thus, the fabric section having the greater fabric weight or thickness will inherently be stiffer. In the embodiment of FIG. 3 and the embodiment described hereinbelow the reinforcing inlay is preferably formed of a monofilament yarn formed of nylon, polyester, polypropylene or the like. Monofilament yarns preferably range in thickness from about 0.003 to about 0.012 inch, with polyester yarn of about 0.007 inch thickness being preferred. However, yarns outside this range may be acceptable in practicing this invention. The threads should be chosen to form a desired thickness for the center region and the side regions. The thickness of each region is chosen according to the price category and quality desired. However, regardless of the thickness chosen the overall relationship between the center region and the side regions remains the same. It is preferable that the center region ranges from about 100% to about 20% heavier or thicker than one of the side regions. However, the preferred embodiment includes a center region that is about 50% heavier or thicker (i.e. stiffer) than one of the side regions. In an alternative embodiment, the center region ranges from about 100% to about 20% stiffer than one of the side regions.

Figure 4:
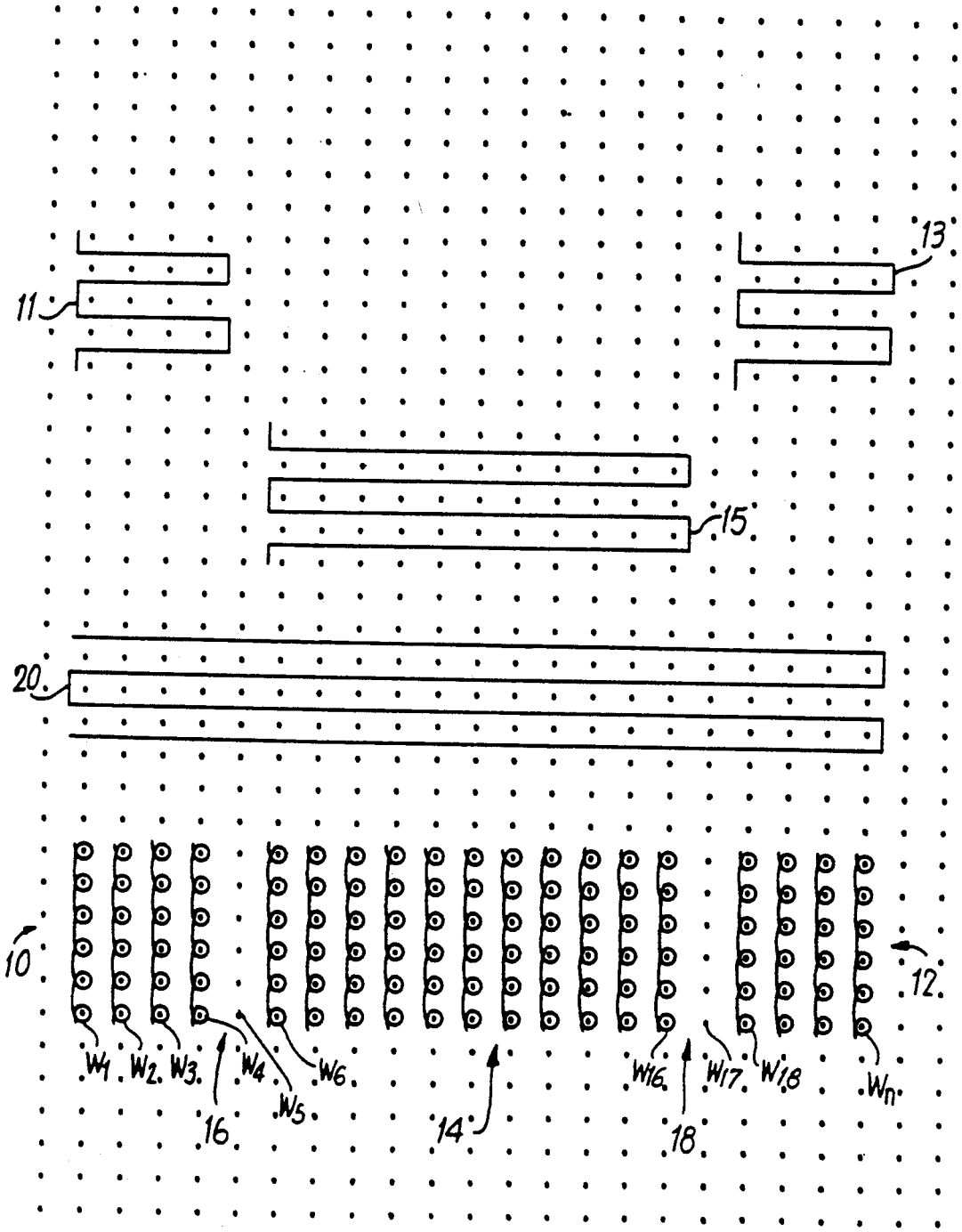
FIG. 4 is a point paper diagram in accordance with the first embodiment of the present invention.

Referring to FIG. 4, a point paper diagram depicting the first preferred embodiment of the invention is provided. Like reference numerals are used to designate like components of the fabric of FIG. 3. This fabric has a first side section generally designated as 10, a second side section generally designated as 12 and a center section generally designated 14 interposed therebetween. The wales or chains of loops $W_1$ through $W_{20}$ are knit throughout the length of the fabric. Ground inlay 20 is configured to transverse the entire width of the fabric, thereby holding first and second side sections 10, 12 and center section 14 together as one fabric. Lateral reinforcing inlays 11, 13 are provided to reinforce side sections 10, 12 respectively. Center reinforcing inlay 15 is provided to reinforce center section 14, thereby increasing the shape holding capability, rigidity and thickness of center section 14. Furthermore, space 16 is provided between side. section 10 and center section 14. Furthermore, space 18 is provided between side section 12 and center section 14. Space 16 and space 18 are provided to enhance the flexibility at the boundary between center section 14 and side sections 10, 12. The spaces are defined by omitting one or more wales or chains of loops at the positions of the spaces.

The warp knit fabric depicted in FIGS. 1 and 2 may have multiple variations and permutations to create a common desired result of greater shape holding capability, rigidity, thickness, density or weight in the center section 14 than in the side sections 10, 12.

While the embodiments of FIGS. 3 and 4 are depicted with four wales or chains of loops in each of the first and second side sections and eleven wales or chains of loops in the third center section, that structure is by way of example and not by way of limitation. The precise number of wales in each section are dictated by the tape's overall width and the desired weight of each section.

One preferred embodiment of the invention that would achieve the desired result of a bulkier center section with enhanced shape holding capability is formed by providing more fabric weight in center section 14. Providing more fabric weight in the center section 14 can be accomplished in various ways. A first way of providing body weight in the center is by providing center reinforcing inlay 15 of a higher denier yarn than that of the lateral reinforcing inlays 10 and 12, for example a yarn of greater than 300 den. Alternatively, the yarn used in center reinforcing inlay 15 can be multiple strands of a lower denier yarn such as multiple strands of 150 den. Both of these embodiments would accomplish a common result of an increased fabric weight across the width of the fabric.

In a preferred embodiment of the invention the ground reinforcing inlay 20 is provided with one strand of 150 den. yarn, the lateral reinforcing inlays 11, 13 are provided with three stands of 150 den yarn, and the center reinforcing inlay 15 is provided with five strands of 150 den. yarn. Providing the inlays with multiple strands of 150 den. yarn is easily manageable, thus producing a cost efficient fabric. Although multiple strands of yarns having denier of approximately 150 den. yarn is a preferable embodiment, the desired effect can be accomplished by using single yarns of higher denier. It is preferable to use yarns ranging from between 70 den. to 700 den.

Another alternative embodiment that accomplishes the desired result is to vary the denier of the yarn used in the warp. If a higher denier yarn is used in the warps of the center section 14 then the warps of side sections 10, 12, then the center section 14 will have greater fabric weight than the side sections 10, 12. Enhanced fabric weight inherently add stiffness and shape holding capability to the fabric. This embodiment is more costly, and thus less preferable than the first embodiment, because the warp stitch requires the needles to engage the yarn to create the loops, and high quality yarn is required to be used, so that it can be engaged by the needle hooks. Alternatively, the yarns that can be used in the inlays are not required to be of as high quality of yarn as those used in the warps, because the inlay yarns are never engaged by the needle hooks. Furthermore, the yarns used in the inlays may be of much heavier count than yarns knit into the warps that must be engaged by the needle hooks.

A fourth approach also less desirable but possible is to open the knit of the first and second side sections relative to the third center section by omitting one or more spaced wales in the first and second sections.

A further method of producing a center section 14 with enhanced shape holding capability is to use a center reinforcing inlay 15 of a yarn that is inherently stiffer than the yarn used in lateral reinforcing inlays 11, 13. This could be accomplished by using a multi-filament in ground inlay 20 and a monofilament in center reinforcing inlay 15. Thus, it is possible to produce an embodiment of this invention wherein the fabric is of uniform thickness and fabric weight across the width of the fabric, but the center section 14 is stiffer than the side sections 10, 12 because of the nature of the yarns used in the inlays of the three sections.

In another alternative embodiment, the lateral reinforcing inlays 11, 13 may be omitted if the ground inlay is of sufficient strength to carry enough weight. Only a center reinforcing inlay 15 would be required to further reinforce and thicken the center section 14. In such a case, ground inlay 20 can be of a heavier yarn, perhaps equal Co the sum of ground inlay 20 and lateral reinforcing inlay 11 of FIG. 4 (first embodiment) while center inlay 15 could be of a lighter, thinner yarn. Thus, the same fabric weight would be maintained at the side sections 10, 12 as in the first preferred embodiment, but less guide bars are required to lay the inlays, because the guide bars used to carry the lateral reinforcing inlays 11, 13 would be eliminated. A comparable fabric is thus formed while eliminating the two lateral reinforcing inlays 11, 13.

In one embodiment of the mattress tape in accordance with the invention, a textured polyester yarn is used in the warp and a polyester monofilament is used in the inlays where appropriate. It would be acceptable to use a variety of other yarns, such as spun yarn, ribbon yarn, vinyl yarn, or other such yarns. A vinyl yarn has a preferred characteristic in that it bulks up under the influence of heat, thus, conferring even greater weight to the center section.

Mattress tapes as designed can be formed in a multiplicity of different widths. It is general practice in the art to form mattress tape in a range of from ⅝" wide to 1¼" wide. However, mattress tape having larger or smaller widths may be formed to cover a top panel and border of a large or small thickness, and give the desired aesthetic appearance. A preferred mattress tape usually labeled as "1¼" wide" has an actual width of 1 9/32".

By way of example, a preferable design of a tape having a width of 1 9/32" would be formed with a center section having a width of between about 12/32" and about 1", two side sections each having a width of from about ⅛"to about 7/16" and two "breaks" (one "break" between the center section and each of the two side sections) each having a width of from about 1/16" to about 3/32". Further, for exemplary purposes, a mattress tape usually labelled "7/8" wide" but normally 29/32" wide would preferably be formed with a center region having a width of from about ¼" to about 25/32" and side regions having a width of from about 1/16" to about 5/16". However, all these ranges may be expanded or contracted to form the aesthetic formation desired at an acceptable cost. It is preferred that the center region define from about 25% to about 90% of the width of the mattress tape.

Figure 5:
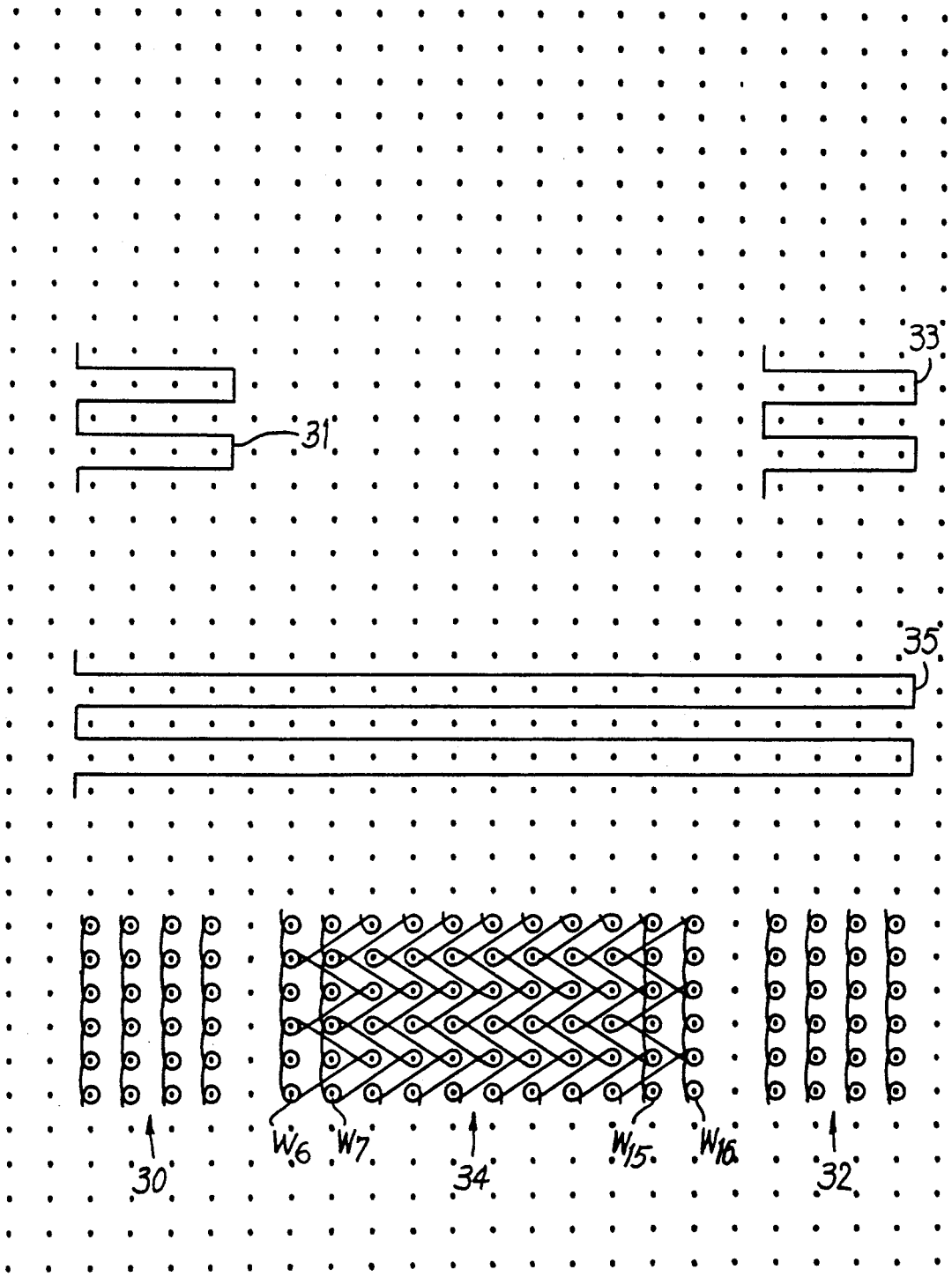
FIG. 5 is a point paper diagram in accordance with a second embodiment of the invention.

With particular reference to FIG. 5 an alternative embodiment of the invention is depicted. The fabric is provided with first side section 30, second side section 32 and center section 34 disposed therebetween. Ground inlay 35 is provided and maintains continuity of the fabric across the width of the fabric. First lateral reinforcing inlay 31 and second lateral reinforcing inlay 33 is provided to enhance rigidity and fabric weight of the first side section 30 and the second side section 32 respectively. Side sections 30, 32 use a pillar stitch in conjunction with lateral reinforcing inlays 31, 33 to provide a fabric with the qualities desired. In center section 34 a tricot stitch (digital representation 1-0, 2-3) is used to provide greater fabric weight in the center section 34, thereby, providing the desired shape holding capability. A tricot stitch requires a greater quantity of yarn to be used in each course, therefore it provides a more dense finished fabric. Further, at each edge of center section 34 two (2) rows of pillar stitches are required to maintain the integrity of the fabric. When knitting a needle must engage the yarn during each course, or else the fabric will not be properly formed. Accordingly, in the embodiment of FIG. 5 wales $W_6$, $W_7$, $W_{15}$ and $W_{16}$ all consist of a wale of pillar stitches, as well as engaging portions of the tricot stitch.

In the second embodiment depicted in FIG. 5 the yarn bridge between side sections 30, 32 and center section 34 would be clearly seen. One wale is eliminated, thus there is a decreased amount of yarn located at the yarn bridge and different stitches are used in the side sections 30, 32 than in the center section 34, thus, producing a different appearance.

Figure 6:
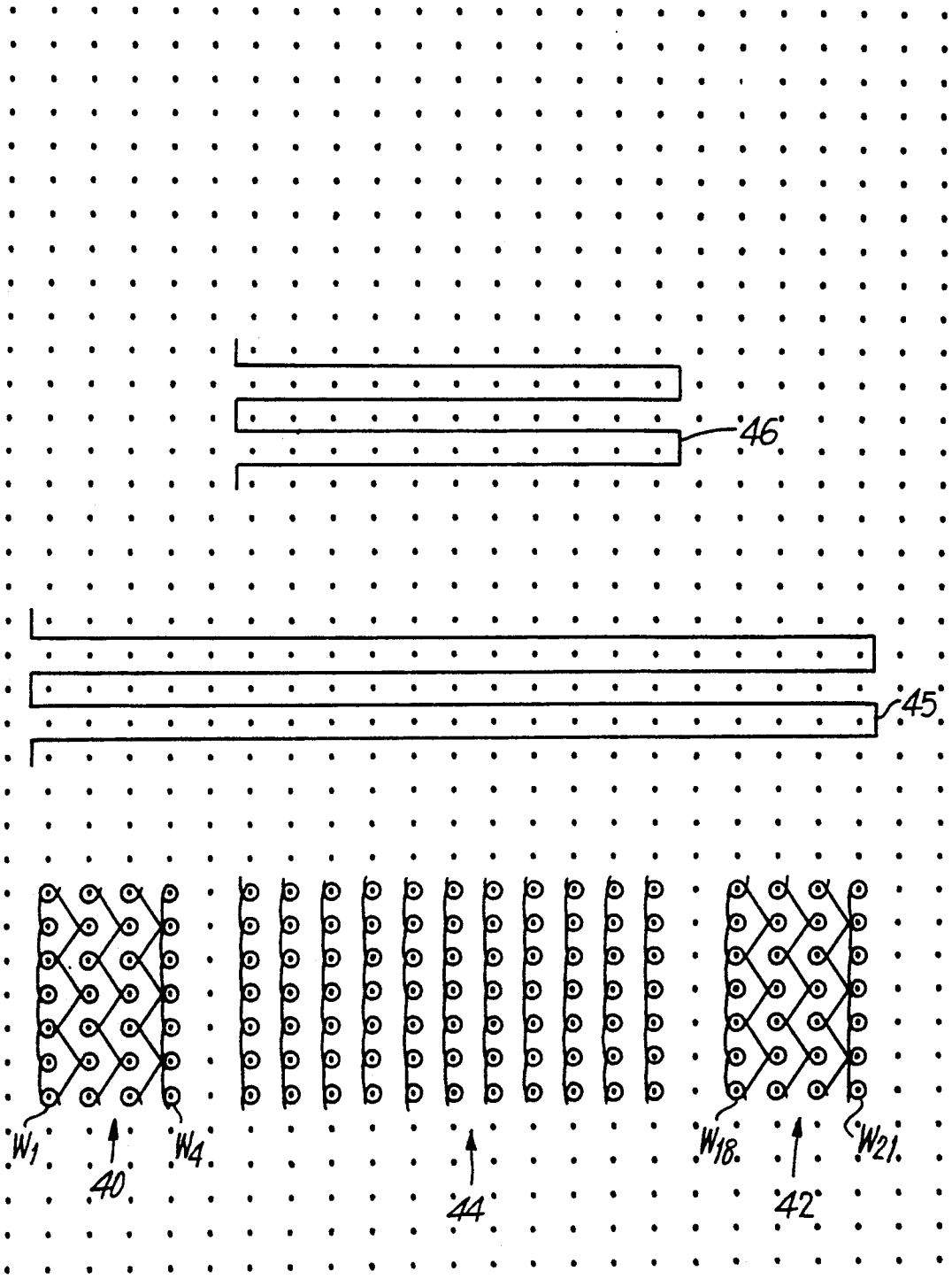
FIG. 6 is a point paper diagram in accordance with a third embodiment of the invention.

Referring specifically to FIG. 6 another alternative embodiment of the invention is disclosed. First and second side sections 40, 42 are provided with center section 44 disposed therebetween. Ground inlay 45 is provided and maintains continuity throughout the fabric and center reinforcing inlay 46 provides the required stiffness and shape holding capability desired by the user. Side sections 40, 42 are designed with the wales in a half tricot stitch (digital representation 1-0, 1-2) and center section 44 uses a pillar stitch. In center section 44 the pillar stitch in the warp in conjunction with center reinforcing inlay 46 provides the desired stiffness and shape holding capability. In side sections 40, 42 a reinforcing inlay is not required because the half tricot stitch is used to provide the desired fabric weight.

Each different stitch used provides a different fabric weight and shape holding capability. Furthermore, each different stitch provides a different appearance so that the desired tailored look may be obtained. At the yarn bridge connecting center section 44 and side sections 40, 42 one wale is removed to create the transition or space region discussed above in connection with the embodiment of FIGS. 3 and 4. Further a pillar stitch is required to be inserted at the edges where each tricot stitch is terminated. For example in FIG. 6 at positions $W_1$, $W_4$, $W_{18}$ and $W_{21}$ pillar stitches are used to maintain the integrity of the fabric.

Figure 7:
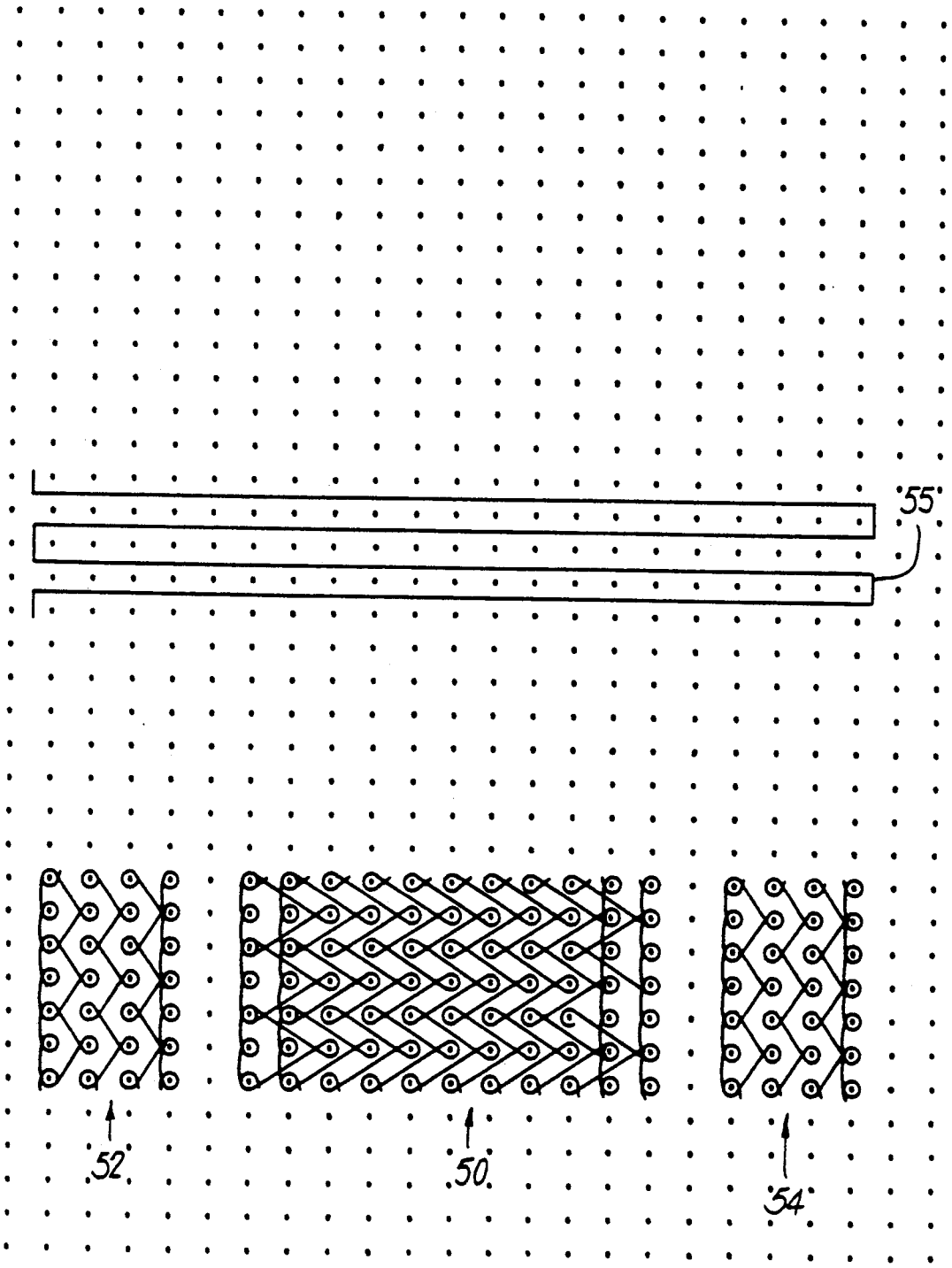
FIG. 7 is a point paper diagram in accordance with a fourth embodiment of the invention.

Referring specifically to FIG. 7 a further embodiment of the invention is provided, wherein a center section 50 is provided disposed between side sections 52, 54. Ground inlay 55 is provided to hold the yarns together as a fabric. Center section 50 is designed having the wales in a tricot stitch and side sections 52, 54 are designed having the wales in a half tricot stitch. Thus, center section 50 is provided with inherently greater fabric weight than side sections 52, 54, because a tricot stitch has inherently greater fabric weight than a half tricot stitch. Additionally, the denier of the yarns used can be varied to produce the desired fabric weight and shape holding capability.

Furthermore, the lines of a demarkation between the center section 50 and side sections 52, 54 would be clearly seen, because side sections 52, 54 have a different stitch than center section 50. Further, one wale on each side of center section 50 is left out, and a yarn bridge remains at that position. As hereinabove stated pillar stitches are provided in the wales where the tricot stitch and half tricot stitches terminate. Thus, the finished mattress tape is provided with the desired tailored appearance. The desired tailored appearance is one without wrinkles, a straight edge and corners that stand up.

Figure 8:
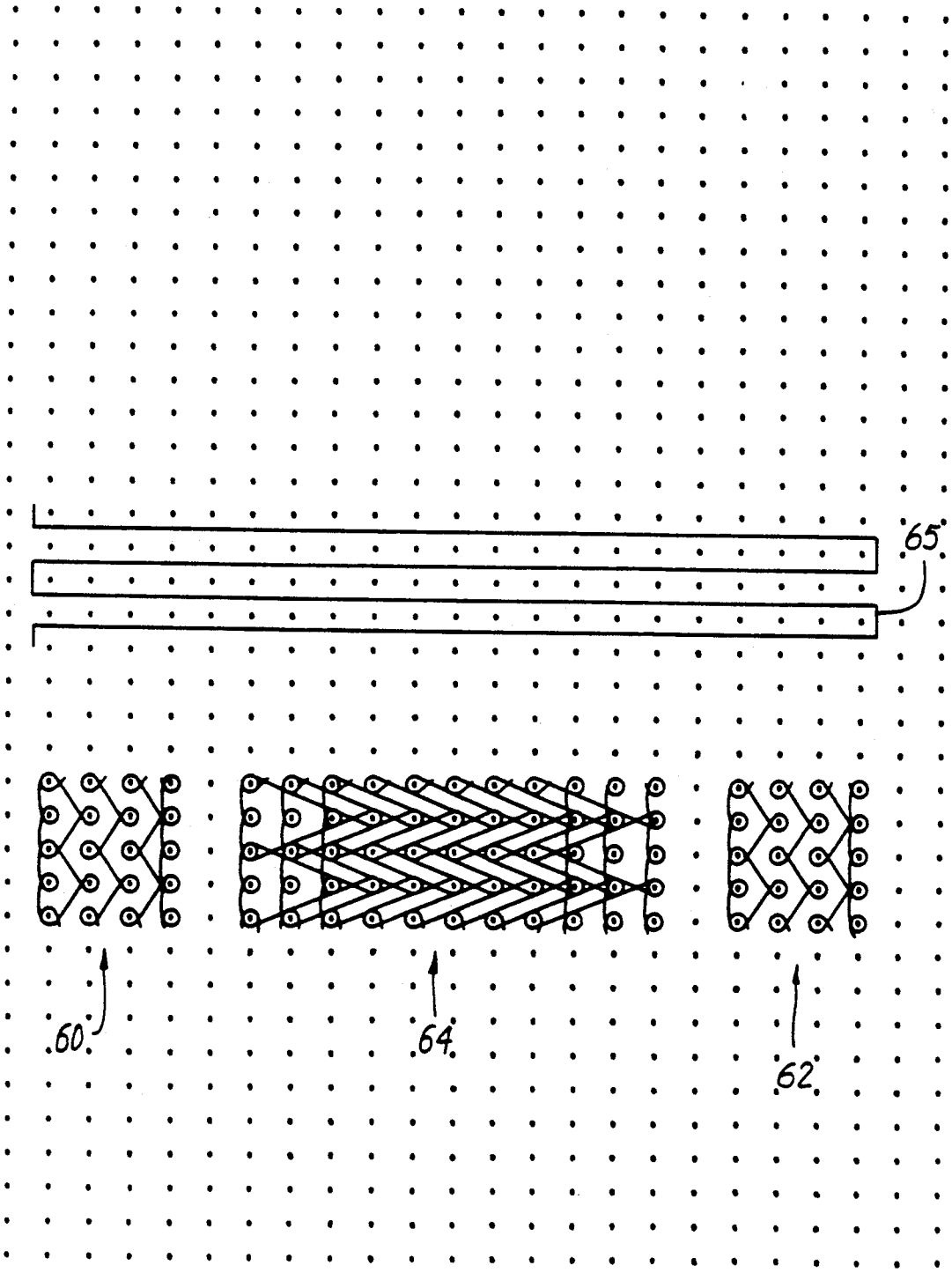
FIG. 8 is a point paper diagram in accordance with a fifth embodiment of the invention.

Referring specifically to FIG. 8 a further embodiment of the invention is depicted, wherein first and second side sections 60, 62 are provided with center section 64 disposed therebetween. Ground inlay 65 is provided for maintaining continuity along the width of the fabric and providing filler material as required. The side sections 60, 62 are designed with the wales in the form of half tricot stitches and the center section 64 is designed with the wales in the form of satin stitches (digital representation 1-0, 3-4). The satin stitch uses much more fiber than the half tricot stitch, thus the center section 64 has a bulkier look and feel than the side sections 60, 62. The increased fabric weight of the center section 64 inherently gives the center section 64 enhanced shape holding capability.

In the embodiment of FIG. 8 the demarkations between the center section 64 and each of the side sections 60, 62 are clearly present due to the variation of stitches and the elimination of one wale of yarn at the position between the center section 64 and each side section 60, 62. Once again pillar stitches are required to fill in thread at positions where the longer satin stitches and tricot stitches terminate. However, the yarn bridge between the center section 64 and the side sections 60, 62 also provides an area of decreased fabric weight to help the fabric bend and track when it is stitched into the mattress. Furthermore, forming the fabric with a satin stitch or other long stitches increases the luster effect and smoothness of the finished fabric. This also adds to the desired aesthetically pleasing finished product.

Forming a mattress tape through a knitting process, such as warp knitting, enables the manufacturer to form designs on the mattress tape. A manufacturer can insert colored threads in patterns to make the mattress tape more aesthetically pleasing. Further, different patterns or different colored threads can be used to code the mattress tape into different fabric weight values for different qualities of mattresses. A significant advantage of the knitted mattress tape over the prior art woven mattress tape is the fact that the woven mattress tapes required use of finishing chemicals to provide the tape with the required body and stability. Such finishing chemicals are not required in the case of knitted mattress tapes.

It is possible to obtain a substantially similar result to that which is described above by a multiplicity of subinlays. A subinlay is an inlay that does not span the entire width of the fabric, but spans a portion of the width of the fabric and overlaps other subinlays that cover other portions of the fabric. For example, a mattress tape could be formed having a ground inlay formed from two (2) subinlays each spanning one half the width of the mattress tape, and overlapping slightly in the middle. This could increase the production speed of the manufacturer because each inlay is carried by its own guide tube, accordingly, each guide tube laying a subinlay is required to travel a shorter distance than a guide tube laying a long ground inlay. Furthermore, in order to cut the distance travelled by the guide tubes even shorter, more subinlays may be added. However, each additional subinlay that is added is required to overlap the next closest subinlay. Accordingly, slightly more yarn is used with each extra subinlay that is added.

Other variations in stitch configuration and yarn selection are possible in accordance with the invention. As noted above, the mattress tape in accordance with the invention may be provided in various weights per yard and thickness as desired and may be used to bond the edge of box springs and a variety of types of mattresses.

In all the embodiments hereinbefore described the preferred yarn weight may range from 70 den. to 700 den., and the specific yarn weight would be chosen in accordance with the appearance desired and the quality desired. A monofilament may be chosen as desired and the yarn type may be chosen in accordance with the quality and appearance desired by the user.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic-and specific features of the invention herein described and all statements of the scope of the invention which, as a matter of language, might be said to fall therebetween.

What is claimed is:

1. A mattress comprising:

a panel defining a major surface of the mattress and terminating in an edge;

a border panel defining a side surface of the mattress and terminating in an edge;

a fabric mattress tape for overlying the adjacent edges of said major surface panel and said border panel, said fabric mattress tape comprising a first side section, a second side section and a third center section disposed therebetween, said third section being formed with greater rigidity thickness and shape holding capability than said first and second sections; and stitch means joining said first and second sections of said fabric mattress tape and said edges of said panels.

2. The mattress as claimed in claim 1, wherein said at least one of said rigidity, thickness and shape holding capability is due to greater fabric weight in the third section as compared to the first and second sections.

3. The mattress as claimed in claim 1, wherein said fabric mattress tape is constructed by warp knitting yarn.

4. The mattress as claimed in claim 3, wherein said at least one of said rigidity, thickness and shape holding capability is due to greater fabric weight in the third section as compared to the first and second sections.

5. The mattress as claimed in claim 4, wherein said warp knit mattress tape includes ground inlay means for joining said first, second and third sections.

6. The mattress as claimed in claim 5, wherein said warp knit mattress tape includes a center reinforcing inlay means extending at least in part across the width of said third section.

7. The mattress as claimed in claim 6, wherein said center reinforcing inlay means is formed from the group consisting of polyester yarn, texturized polyester yarn, nylon yarn, polypropylene yarn, vinyl yarn, spun yarn and ribbon yarn.

8. The mattress as claimed in claim 6, wherein said center reinforcing inlay means intersects a plurality of wales in a chain of loops.

9. The mattress as claimed in claim 8, wherein each of said first and second sections are formed at least in part by a half tricot stitch.

10. The mattress as claimed in claim 9, and including at least one wale in a chain of loops at each side periphery of each of said half tricot stitch portion of said first and second sections.

11. The mattress as claimed in claim 9, and including a relatively narrow space region intermediate said first and third sections and said second and third sections.

12. The mattress as claimed in claim 11, wherein said space region is a region in which at least one wale is omitted and neither said center reinforcing inlay means nor said half tricot stitch is found.

13. The mattress as claimed in claim 6, wherein said warp knit mattress tape includes at least one lateral reinforcing inlay means in each of said first and second sections.

14. The mattress as claimed in claim 13, wherein said at least one lateral reinforcing inlay means intersects a plurality of wales in a chain of loops.

15. The mattress as claimed in claim 14, and including a relatively narrow space region intermediate said first and third sections and said second and third sections.

16. The mattress as claimed in claim 15, wherein said space region is a region in which at least one of said wales is omitted and neither said center nor said at least one lateral reinforcing inlay means is found.

17. The mattress as claimed in claim 14, and including fewer wales per unit width in said first and second sections than in said third section.

18. The mattress as claimed in claim 13, wherein said center reinforcing inlay means is formed of yarn means of a greater weight for per unit length than the yarn means of said at least one lateral reinforcing inlay means.

19. The mattress as claimed in claim 18, wherein said center reinforcing inlay means is formed of larger denier yarn means than said at least one lateral reinforcing inlay means.

20. The mattress as claimed in claim 18, wherein the sum of the denier of said yarn means comprising the center reinforcing inlay is larger than the sum of the denier of the yarn means comprising each of said at least one lateral reinforcing inlays means.

21. The mattress as claimed in claim 5, wherein the third section is formed by a tricot stitch.

22. The mattress as claimed in claim 21, wherein said tricot stitched third section further includes (1) at least two wales including tricot stitches and (2) a pillar stitch at each side periphery of the third section.

23. The mattress tape as claimed in claim 22, wherein said warp knit mattress tape includes at least one lateral reinforcing inlay means in each of said first and second sections.

24. The mattress as claimed in claim 23, wherein said at least one lateral reinforcing inlay means intersects a plurality of wales in a chain of loops.

25. The mattress as claimed in claim 24, and including a relatively narrow space region intermediate said first and third sections and said second and third sections.

26. The mattress as claimed in claim 25, wherein said space region is a region in which at least one of said wales is omitted and neither said lateral reinforcing inlay means nor said tricot stitch is found.

27. The mattress as claimed in claim 22, wherein each of said first and second sections are formed at least in part by a half tricot stitch.

28. The mattress as claimed in claim 27, and including at least one wale in a chain of loops at each side periphery of each of said half tricot stitch portion of said first and second sections.

29. The mattress as claimed in claim 28, and including a relatively narrow space region intermediate said first and third sections and said second and third sections.

30. The mattress as claimed in claim 29, wherein said space region is a region in which at least one wale is omitted and neither said tricot nor said half tricot stitches is found.

31. The mattress as claimed in claim 5, wherein said third section is formed by a satin stitch.

32. The mattress as claimed in claim 31, wherein said satin stitch further includes at least three wales formed from a chains of loops at each side periphery of the third section.

33. The mattress as claimed in claim 32, wherein each of said first and second sections are formed at least in part by a half tricot stitch.

34. The mattress as claimed in claim 33, and including at least one wale in a chain of loops at each side periphery of each of said half tricot stitch portion of said first and second sections.

35. The mattress as claimed in claim 34, and including a relatively narrow space region intermediate said first and third sections and said second and third sections.

36. The mattress as claimed in claim 35, wherein said space region is a region in which at least one wale is omitted and neither said satin stitch nor said half tricot stitch is found.

37. The mattress as claimed in claim 3, wherein at least one of the rigidity, thickness and the shape holding capability is due to at least a portion of the yarn forming the third section having a greater stiffness than the yarn forming said first and second sections.

38. The mattress as claimed in claim 2, wherein the third section is from about 20% to about 100% heavier than the first or second sections.

39. The mattress as claimed in claim 1, wherein said third section is from about 25% to about 90% of the width of the fabric mattress tape.

40. The mattress as claimed in claim 1, wherein said fabric mattress tape is about 1¼" wide, said third section having a width of from about 12/32" to about 1".

41. The mattress as claimed in claim 1, wherein said fabric mattress tape is about 7/8" wide, said third section having a width of from about ¼" to about 25/32".

42. The mattress as claimed in claim 1, and including a narrow space region between said first and third sections and said second and third sections adapted to provide a flexible transition between said adjacent sections.

43. The mattress as claimed in claim 42, wherein said space regions are each thinner than said first, second and third regions.

44. The mattress as claimed in claim 43, wherein said space regions are each from about 1/18" to about 3/32" wide.

45. The mattress as claimed in claim 1, wherein the relative width of the third section and said first and second sections is selected to permit the stitching of said mattress tape to define the edge of a mattress, wherein said stitching is through said first and second sections of said mattress tape, and wherein said third section defines a substantially smooth visible edge to said mattress edge.

* * * * *